US005809603A

United States Patent [19]

White

[11] Patent Number: 5,809,603

[45] Date of Patent: Sep. 22, 1998

[54] PIPE CLEANING TOOL

[76] Inventor: James C. White, 1403 S. Mitchell, Oak Grove, Mo. 64075

[21] Appl. No.: 696,262

[22] Filed: Aug. 13, 1996

[51] Int. Cl.[6] ..... B08B 9/02

[52] U.S. Cl. ..... 15/104.04; 15/104.095; 15/104.18; 29/81.02

[58] Field of Search ..... 15/104.04, 104.17, 15/104.18, 104.19, 104.05, 104.095, 236.1, 236.09, 236.05, 236.06, 104.16, 104.13; 29/81.02, 81.05, 81.021, 81.01, 81.11

[56] References Cited

U.S. PATENT DOCUMENTS

| | | | |
|---|---|---|---|
| H1130 | 1/1993 | Place et al. | 15/104.18 |
| 753,189 | 2/1904 | Buckelew et al. | 15/104.18 |
| 2,225,272 | 12/1940 | Horne | 15/104.03 |
| 2,279,922 | 4/1942 | Kraner | 15/104.04 |
| 3,290,711 | 12/1966 | Swanson | 15/104.03 |
| 3,383,727 | 5/1968 | Hanson | 15/104.04 |
| 4,246,728 | 1/1981 | Leasher | 15/104.04 |
| 4,744,123 | 5/1988 | Le Testu et al. | 15/104.04 |

FOREIGN PATENT DOCUMENTS

| | | | |
|---|---|---|---|
| 329114 | 2/1903 | France | 15/104.18 |
| 6551 | 3/1884 | United Kingdom | 15/104.18 |

*Primary Examiner*—Gary K. Graham
*Attorney, Agent, or Firm*—Hovey, Williams, Timmons & Collins

[57] ABSTRACT

A pipe cleaning tool (10) comprises a cleaning assembly (12) and a hollow riser (14) received over the assembly (12). The cleaning assembly (12) defines and axis of rotation and includes a drive shaft (16) for rotating the assembly about the axis and resilient blades (18) operatively coupled with the drive shaft (16). The blades (18) include first and second edges (24, 26), and are movable between contracted and expanded conditions. The riser (14) is configured for axial movement relative to the cleaning assembly (12) between first and second positions for shifting the blades (18) between the contracted and expanded conditions. The tool (10) is configured for cleaning pipe prior to joining pipe.

8 Claims, 1 Drawing Sheet

PIPE CLEANING TOOL

BACKGROUND OF THE INVENTION

1. Field of the Invention

The present invention relates to a device for preparing tubular elements to be joined together. More particularly, the tool of the present invention is adapted for use in preparing tubular elements of various sizes.

2. Description of Prior Art

Prior to joining tubular elements together, the contact surfaces thereof must be prepared to strengthen the resultant joint. For example, copper pipes, which are joined together in a process known as sweating, are prepared by abrading the surfaces of the pipes adjacent to the pipe joint. Abrasion of these surfaces strengthens the bond between the joined pipes to provide a long lasting pipe joint.

It is known to use a brush for abrading the inner surface of a first pipe in preparation for joining the first pipe with a second pipe received in an end of the first pipe. Such a brush generally includes a rod having bristles mounted at an end thereof extending radially outward. The brush is inserted into the end of the first pipe for abrading the inner surface of the first pipe.

A device which is known for preparing the outer surface of the second pipe includes a cylindrical body having a plurality of bristles extending radially inward. The device is inserted over the end of the second pipe for abrading the outer surface of the second pipe. Once the inner surface of the first pipe and outer surface of the second pipe have been prepared, the pipes may be bonded together by sweating.

Although, such prior art pipe cleaning devices are effective at preparing the surfaces of the pipes prior to joining the pipes, these devices are generally effective at cleaning only a very limited range of sizes of pipes, such as about ¼" in diameter. Therefore, plumbers and other professionals who frequently join pipes of varying sizes together must purchase a complete set of such devices, increasing the costs of doing business. For example, most common copper pipes are between about a ½" to 1" in diameter. As a result, a plumber must purchase three sizes of brushes for cleaning the inner surfaces, and three sizes of outer surface cleaning devices in order to be able to clean and prepare most pipes. In addition, such devices are susceptible to wear and must be frequently replaced.

It is also known to provide a generally universal pipe cleaner for cleaning inner and outer surface of pipes of varying sizes. The universal device includes a plate having a pair of uniquely sized apertures with a plurality bristles extending radially inward. The sizing of the apertures permits the universal device to be used for abrading the outer surfaces of pipes of several different sizes. The universal device also includes a pair of rods extending from the plate. Each rod includes an end with bristles extending radially outward from the rod to define a pair of bristle brushes. The brushes include bristles of different lengths so that the brushes are of different sizes for abrading the inner surfaces of pipes of varying sizes.

Although such a universal device is available to prepare pipes of varying sizes, this device is relatively expensive and is also susceptible to wear so that it must be frequently replaced. Therefore, a significant and heretofore unresolved need exists to provide a pipe cleaning tool addressing the above mentioned problems.

SUMMARY OF THE INVENTION

It is an object of the present invention to provide a tool for cleaning pipes of varying sizes in preparation for joining pipes together.

It is another object of the present invention to provide a tool for cleaning pipes including resilient members that are relatively more durable than the bristles of prior art devices.

A pipe cleaning tool for cleaning an end of a pipe broadly includes a cleaning assembly and a hollow riser received over the cleaning assembly. It is noted that although the term "pipe" is used in discussing the tool of the present invention, the tool may be used to clean or otherwise prepare tubular elements of any kind to be joined together. Such tubular elements include pipes, conduits, fittings, etc., constructed of metals, plastics or any other suitable material.

The cleaning assembly defines an axis of rotation and includes a drive shaft for rotating the assembly about the axis of rotation and at least one elongated member operatively coupled with the drive shaft. The member is resilient and biased toward an expanded condition. The member is moveable toward a contracted condition. In addition, the member includes first and second edges for cleaning inner and outer surfaces of a pipe. The first edge is configured for contacting the inner surface of the pipe when the member is expanded. The second edge is configured for contacting the outer surface of the pipe when the member is contracted.

The riser is selectively shiftable relative to the cleaning assembly between first and second positions for movement of the member between the contracted and expanded conditions, respectively. When the riser is in the first position, the member is fully withdrawn into the riser and is in the contracted condition. As the riser is shifted toward the second position, the member becomes at least partially extended from the riser, and moves toward the expanded condition.

By providing a member having a pair of edges for alternately contacting the inner and outer surfaces of the pipe, and that may be moved between expanded and contracted conditions, the tool of the present invention may be advantageously used on a number of pipes of varying sizes. In addition, the design of the present inventive tool yields a relatively more durable pipe cleaner compared to the prior art devices.

DESCRIPTION OF THE DRAWING FIGURES

DETAIL DESCRIPTION OF THE PREFERRED EMBODIMENT

Figures 1, 2, 3, 4, 5, 6:
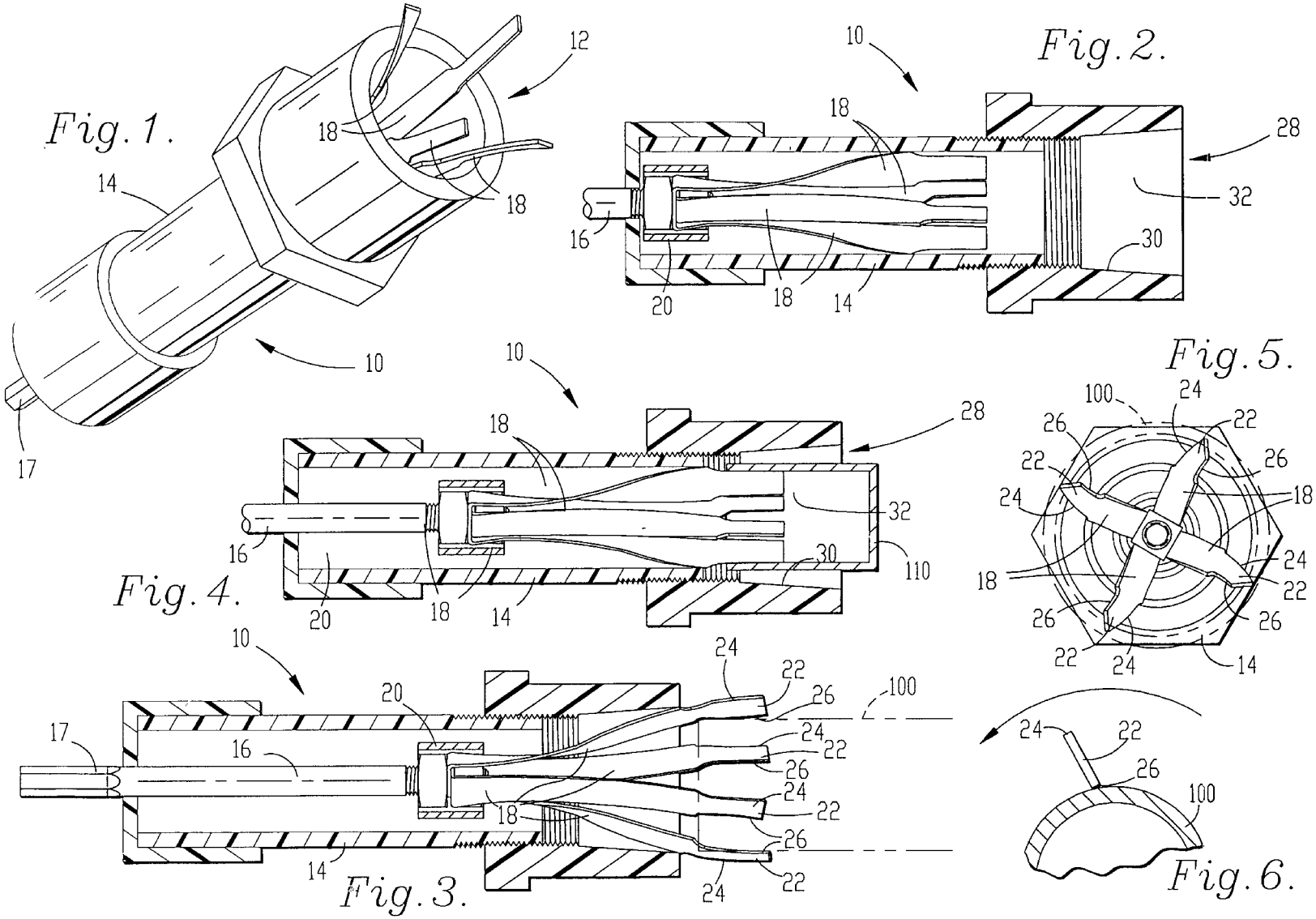
FIG. 1 is a perspective view of a pipe cleaning tool constructed in accordance with a preferred embodiment of the present invention.
FIG. 2 is a sectional view of the tool of FIG. 1 showing a cleaning assembly having a plurality of elongated members in a contracted condition.
FIG. 3 is sectional view of the tool of FIG. 1 showing the members in an expanded condition and a pipe received between the members.
FIG. 4 is a sectional view of the tool of FIG. 1 showing a fitting received in the tool and the members positioned in the fitting for cleaning the fitting.
FIG. 5 is a front elevational view of the tool of FIG. 1 showing the members received in a fitting.
FIG. 6 is a sectional view of a pipe and a member contacting an outer surface of the pipe for cleaning the pipe.

Referring now to FIG. 1, a pipe cleaning tool 10 constructed in accordance with the preferred embodiment of the present invention is illustrated. The tool 10 comprises a cleaning assembly 12 and a hollow riser 14 received over the cleaning assembly 12. The tool 10 is configured to be coupled with a hand-held electric drill so that the cleaning assembly 12 may be positioned to selectively scrape inner and outer surfaces of a pipe 100 in preparation for joining the pipe 100 with another pipe or fitting 110. The tool 10 may alternatively be rotated by hand, or any other suitable means.

As shown in FIG. 2, the cleaning assembly 12 defines an axis of rotation and includes a drive shaft 16 having a shank 17 for rotating the assembly 12 about the axis of rotation. The assembly 12 also includes elongated, resilient blades 18 constructed from metal and operatively coupled with the drive shaft 16. A sleeve 20 is received over the coupling of the blades 18 and drive shaft 16. The blades 18 include free ends defining tips 22, and opposed, first and second edges 24, 26, adjacent to tips 22. The blades 18 may be moved between expanded and contracted conditions, and are biased toward the expanded condition.

The riser 14 is constructed from synthetic resin material, such as polyvinyl chloride (PVC), and includes structure defining an open end 28, and an interior wall 30 defining a conical portion 32. The riser 14 is configured for axial movement relative to the cleaning assembly 12 between first and second positions. In the first position, the blades 18 are withdrawn into the riser 14 and retained by the riser 14 in the contracted condition, as shown in FIG. 2. When the riser 14 is in the second position, the tips 22 of blades 18 extend from the riser 14 and the blades 18 are in the expanded condition, as shown in FIG. 1. The sleeve 20 is provided to facilitate movement of the riser 14 over the cleaning assembly 12. In addition, a security pin may be provided through the riser 14 to prevent the cleaning assembly 12 from being pulled from the riser 14.

Referring now to FIG. 5, the blades 18 each define a longitudinal axis, and are twisted about their respective longitudinal axes. FIG. 5 depicts the blades 18 inserted into a pipe 100 so that the first edges 24 of the blades 18 are in contact with an inner surface of the pipe 100. When the cleaning assembly 12 is rotated in a first direction, clockwise when viewing FIG. 5, the tips 22 of the blades 18 form an acute angle with the inner surface of the pipe 100 in the direction of rotation so that the first edges 24 are scraped along the inner surface of the pipe 100.

Referring now to FIG. 3, the tool 10 has been positioned so that the blades 18 are wrapped about the outer surface of the pipe 100. In this position, the second edges 26 of the blades 18 are in contact with the outer surface of the pipe 100. When the cleaning assembly 12 is rotated in a second direction, as shown in FIG. 6, the tips 22 of the blades 18 form an acute angle with the outer surface of the pipe 100 in the direction of rotation so that the second edges 26 are scraped along the outer surface of the pipe 100.

In operation, the tool 10 is coupled with a rotation driving source, such as a drill, and used to prepare tubular elements prior to joining the elements together. For example, many plumbing operations require that a fitting 110 be joined with a pipe 100. The fitting 110 is generally of a larger diameter than the pipe 100 so that the fitting 110 is received over the end of the pipe 100. In such an application, the tool 10 is used to prepare the inner surface of the fitting 100 and the outer surface of the pipe 100 adjacent to the joint.

In preparing the inner surface of the fitting 110, the riser 14 is shifted to the first position, as shown in FIG. 2, so that the blades 18 are withdrawn into the riser 14 and retained in the contracted condition. The fitting 110 is then inserted through the open end 28 of the riser 14. It will be appreciated that the conical portion 32 of the riser 14 is configured to receive fittings of various diameters. For example, tool 10 may accommodate fittings having inside diameters of between about ½" to about 1 ½".

Next, the riser 14 is shifted toward the second position, extending the tips 22 of the blades 18 into the fitting until the first edges 24 of the blades 18 are pressed against the inner surface of the fitting 110, as shown in FIG. 4. The tool 10 is rotated by the driving source in the first direction so that the first edges 24 are scraped along the inner surface of the fitting 110, preparing the inner surface. Once the inner surface of the fitting 110 has been prepared, the riser 14 is shifted to the first position, withdrawing the blades 18 from the fitting 110, and the fitting 110 is removed from the open end 28 of the riser 14.

The outer surface of the pipe 100 is prepared by shifting the riser 14 to the second position, as shown in FIG. 1, and inserting the pipe 100 between the blades 18. The riser 14 is then shifted toward the first position until the second edges 26 of the blades 18 are pressed against the outer surface of the pipe 100, as shown in FIG. 3. It will be appreciated that the blades 18 are moveable so that pipes of various diameters may be accommodated between blades 18. For example, the tool 10 is configured for receiving pipes having an outside diameter of between about ¼" and 1 ½".

The tool 10 is then rotated in the second direction so that the second edges 26 of the blades 18 are scraped along the outer surface of the pipe 100, preparing the pipe 100 to be joined to the fitting 110. Once the pipe 100 has been prepared, the riser 14 is shifted to the second position, expanding the blade 18 to release the pipe 100, and the pipe 100 is withdrawn from the blade 18.

It will be appreciated that the blades 18 of the tool 10 are relatively more durable than the prior art bristle brushes, and therefore the tool 10 will advantageously have a longer operational life. In addition, the ability to couple the tool 10 with a drill or other rotational driving source reduces the physical demands on the operator. The ability to move the blades 18 between contracted and expanded conditions renders the tool 10 of the present invention relatively more versatile than the prior art pipe cleaning devices. Therefore, a plumber is not required to purchase as many prior art brushes and other devices in order to clean and prepare the same range of pipes, and other tubular elements.

The tool 10 has been described in accordance with the illustrated preferred embodiment. It is noted that changes and variations may be made and equivalence employed without departing from the scope of the invention as set forth in the claims. For example, the riser 14 has been shown as being constructed from three components. The riser may also be constructed from a unitary piece. In addition, the edges 24, 26 adjacent to tips 22 have been shown as a cleaning element for cleaning an end of a pipe 100, fitting 110, or any other tubular element. Abrasive pads, or any other suitable cleaning element, may alternatively be provided on blades 18 for cleaning the end of a pipe 100, fitting 110, or any other tubular element.

What is claimed is:

1. A tool for cleaning an end of a pipe comprising:

a cleaning assembly defining an axis of rotation and including a drive shaft for rotating the assembly about the axis of rotation and means for cleaning an inner surface of a pipe adjacent to an end of the pipe, and for cleaning an outer surface of the pipe adjacent to the pipe end, the cleaning means including an elongated, resilient member operatively coupled with the drive shaft, the member including a free end defining a laterally extending tip having spaced apart first and second edges, and being moveable between expanded and contracted conditions, the tip being relatively closer to the axis of rotation in the contracted condition compared to the expanded condition, the first edge being configured for selectively contacting the inner surface of the pipe and the second edge being configured for selectively contacting the outer surface of the pipe; and a means for moving the member from the expanded condition toward to contracted condition, said elongated member including a resilient blade, said elongated member defining a longitudinal axis, the member being twisted about the longitudinal axis so that as the cleaning assembly is rotated about the axis of rotation in a first direction the tip forms an acute angle with the inner surface when the first edge is in contact with the inner surface of the pipe, and as the cleaning assembly is rotated in a second direction the tip forms an acute angle with the outer surface when the second edge is in contact with the outer surface of the pipe.

2. The tool as set forth in claim 1, wherein the moving means includes a hollow riser received over the cleaning assembly, the riser being configured for axial movement with respect to the cleaning assembly for moving the member between the expanded and contracted conditions.

3. The tool as set forth in claim 2, wherein the riser includes structure defining and open end, and an interior wall defining a conical portion adjacent to the open end.

4. A tool for cleaning an end of a pipe comprising:

a cleaning assembly defining an axis of rotation and including a drive shaft for rotating the assembly about the axis of rotation and an elongated member having a free end defining a laterally extending tip and a cleaning element adjacent to the tip, the member being operatively coupled with the drive shaft, and being biased toward an expanded condition and moveable toward a contracted condition where the tip is relatively closer to the axis of rotation compared to the expanded condition; and a hollow riser received over the cleaning assembly for shifting the member between the contracted and expanded conditions, the riser being configured for axial movement relative to the cleaning assembly between a first position where the cleaning element of the member is withdrawn into the riser and the member is in the contracted condition, and a second position where the cleaning element of the member extends from the riser and the member is in the expanded condition, said elongated member including a resilient blade, and the cleaning element including spaced apart first and second edges of the tip, said elongated member defining a longitudinal axis, the member being twisted about the longitudinal axis so that as the cleaning assembly is rotated about the axis of rotation in a first direction the tip forms an acute angle with the inner surface when the first edge is in contact with the inner surface of the pipe, and as the cleaning assembly is rotated in a second direction the tip forms an acute angle with the outer surface when the second edge is in contact with the outer surface of the pipe.

5. The tool as set forth in claim 4, wherein the riser includes structure defining an open end, and an interior wall defining a conical portion adjacent to the open end.

6. A tool configured to be operatively coupled with a drill for cleaning an end of a pipe comprising:

a cleaning assembly defining an axis of rotation and including a drive shaft for rotating the assembly about the axis of rotation and means for cleaning an inner surface of a pipe adjacent to an end of the pipe and for cleaning an outer surface of the pipe adjacent to the pipe end, the cleaning means including a pair of elongated, resilient blades operatively coupled with the drive shaft, each of the blades having a free end defining a laterally extending tip having opposed, spaced apart first and second edges, the first edges of the blades being configured for selectively contacting the inner surface of the pipe and the second edges of the blades being configured for selectively contacting the outer surface of the pipe, the blades being biased toward an expanded condition and moveable toward a contracted condition were the tips are relatively closer to the axis of rotation compared with the expanded condition; and a hollow riser received over the cleaning assembly for moving the blades between the expanded and contracted conditions, the riser being configured for axial movement relative to the cleaning assembly between a first position where the blades are in the contracted condition, and a second position where the blades are in the expanded condition, said elongated blades each defining a longitudinal axis, the blades being twisted about their respective longitudinal axes so that as the cleaning assembly is rotated about the axis of rotation in a first direction the tips form an acute angle with the inner surface when the first edges are in contact with the inner surface of the pipe, and as the cleaning assembly is rotated in a second direction the tips form an acute angle with the outer surface when the second edges are in contact with the outer surface of the pipe.

7. The tool as set forth in claim 6, wherein the riser includes structure defining an open end, and an interior wall defining a conical portion adjacent to the open end.

8. The tool as set forth in claim 6, wherein the riser is configured so that when the riser is in the first position the blades are withdrawn into the riser and when the riser is in the second position the tips of the blades extend from the riser.

* * * * *